US006556121B2

(12) United States Patent
Endo et al.

(10) Patent No.: US 6,556,121 B2
(45) Date of Patent: Apr. 29, 2003

(54) FUSE ASSEMBLY

(75) Inventors: Takayoshi Endo, Shizuoka (JP); Goro Nakamura, Shizuoka (JP); Hiroki Kondo, Shizuoka (JP); Takahiro Sato, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 62 days.

(21) Appl. No.: 09/819,763

(22) Filed: Mar. 29, 2001

(65) Prior Publication Data

US 2001/0026210 A1 Oct. 4, 2001

(30) Foreign Application Priority Data

Mar. 31, 2000 (JP) ..... 2000-099744

(51) Int. Cl.[7] ..... H01H 85/02; H01H 85/143

(52) U.S. Cl. ..... 337/260; 337/142; 337/186; 337/198; 337/290; 337/380

(58) Field of Search ..... 337/142, 186, 337/197, 198, 227, 255, 298, 290, 380, 260

(56) References Cited

U.S. PATENT DOCUMENTS 4,056,884 A * 11/1977 Williamson et al. ..... 29/417
4,224,592 A * 9/1980 Urani et al. ..... 29/623
4,349,804 A * 9/1982 Gaia ..... 337/198

FOREIGN PATENT DOCUMENTS

JP 55-165539 12/1980

* cited by examiner

*Primary Examiner*—Jayprakash N. Gandhi
(74) *Attorney, Agent, or Firm*—Armstrong, Westerman & Hattori, LLP

(57) ABSTRACT

A fuse assembly which can securely halt an electric power supply to a load after a blowout of a fuse element in the fuse assembly is provided. The fuse assembly 1 has a pair of terminals 2, a housing 4 and a fuse element 5. Ends 3*a* of the terminals 2 are received into the housing 4. A pair of the terminals 2 and the fuse element 5 are formed integrally with each other. The fuse element 5 has a pair of supporting parts 39 and the central part 40. The supporting part 39 has a first extended part 41 connected to an end surface 8 of the terminal 2. The central part 40 connects a pair of the supporting parts 39 with each other and is situated at the center between a pair of the terminals 2. A thickness T2 of the fuse element 5 at the central part 40 is formed smaller than a thickness T1 of the fuse element 5 at the first extended part 41.

3 Claims, 4 Drawing Sheets

FUSE ASSEMBLY

BACKGROUND OF THE INVENTION (1). Field of the Invention

This invention relates to a fuse assembly and more specifically, to a fuse assembly that can securely halt an electric power supply to a load after a blowout of a fuse element in the fuse assembly.

(2). Description of the Related Art

In a vehicle as a mobile unit, many electric power transfer lines for transferring electric power itself or signals, such as busbars in an electric junction box such as a junction block, relay box and fuse block, and terminals of a connector for electric connection, are disposed.

In the electric power transfer lines, a fuse block, in which many fuses that can be inserted or extracted are disposed, is employed to protect electric circuits of various electrical equipments. (The fuse block may be called a relay box, junction block or electric junction box as the general term since the fuse block may have relays or busbars. In this specification, the aforementioned fuse block, relay box and junction block are hereinafter called an electric junction box as the general term.)

For example, a fuse assembly 101 shown in FIG. 5 has been employed as a fuse for use in the electric junction box. As shown in FIGS. 5 and 6, the fuse assembly 101 includes a pair of terminals 102 arranged in parallel with each other, a housing 104 for receiving ends 103 of the terminals 102, and a fuse element 105 formed integrally with a pair of the terminals 102 for connecting the terminals 102 with each other.

The terminal 102 is made of an electrically conductive metal and is formed in a blade-shape as shown in FIG. 6. The terminal 102 is provided with a plurality of through holes 106. Each terminal 102 shown in FIGS. 5 and 6 has two through holes 106. The through holes 106 are disposed in parallel with each other along the direction of the length of the terminal 102. One through hole 106 is formed at the center 107 of the terminal 102 along the direction of the length of the terminal 102 and another through hole 102 is formed around the end 103 of the terminal 102.

When the fuse assembly 101 is mounted in the electric junction box, each opposite end 108 of a pair of the terminals 102 is connected to respective receiving terminals of the electric junction box. An electric power is supplied to one of the receiving terminals from an electric power source or the like, while various loads are electrically connected to an opposite receiving terminal.

An electric power is supplied to one of the terminals 102 through the receiving terminal and the like, while the load is connected to another terminal 102. Each end 103 of the terminals 102 is received into the housing 104 with each inner surface 109 of the terminals 102 facing with each other.

The housing 104 is made of insulating synthetic resin and the like. The housing 104 is formed in a box-shape. The inside of the housing 104 is a receiving space for receiving each end 103 of a pair of the terminals 102. The housing 104 is provided with each projection (not shown in the figure) for engaging with the respective through holes 106. When each projection is engaged with the respective through hole 106, a pair of the terminals 102 is fixed in the housing 104.

As shown in FIG. 6, the fuse element 105 connects the terminals 102 with each other. Each end of the fuse element 105 is connected to the inner surface 109 situated at the center 107 of the terminal 102. The thickness of the fuse element 105 is about uniformly formed between one connection part 105*a* connecting with one terminal 102 and another connection part 105*b* connecting with another terminal 102. The fuse element 105 blows out when a current of an electric power supplied from one of the terminals 102 exceeds a predetermined current value.

As to the fuse assembly 101 mounted in the electric junction box, when a current value of an electric power supplied to the one terminal 102 through the one receiving terminal or the like exceeds a predetermined current value, the fuse element 105 blows out so as to halt the power supply to the load.

As to a conventional fuse 101 shown in FIG. 5, the thickness of the fuse element 105 is about uniformly formed between one connection part 105*a* connecting with one terminal 102 and another connection part 105*b* connecting with another terminal 102. The fuse element 105 tends to blow out at the thinnest portion thereof. The thinnest portion may be located at any portion of the fuse element 105 between one connection part 105*a* and another connection part 105*b*, due to a variation in the manufacturing process. That is, the thinnest portion of the fuse element 105 may be different among the fuse assemblies 101.

Therefore, as to the conventional fuse assembly 101, the fuse element 105 may blow out at any portion of the fuse element 105 between one connection part 105*a* and another connection part 105*b*. For example, when the fuse element 105 blows out in the vicinity of one connection part out of the connection part 105*a* and the connection part 105*b*, the fuse element 105 connected to an opposite connection part becomes in a so-called cantilever state.

At this time, due to a vibration of the vehicle during the traveling or a sudden acceleration, the fuse element 105 vibrates in the housing 104 and then, a pair of the blown-out portions of the fuse element 105 may come into contact with each other, resulting in that the blown-out fuse element 105 may electrically connect a pair of the terminals 102 with each other.

SUMMARY OF THE INVENTION

It is therefore an objective of the present invention to solve the above problem and to provide a fuse assembly which can securely halt an electric power supply to a load after a blowout of a fuse element in the fuse assembly.

In order to attain the above objective, the present invention is to provide a fuse assembly comprising: a pair of terminals arranged in parallel with each other; a housing for receiving each one end of a pair of the terminals; and a fuse element for connecting a pair of the terminals with each other, wherein a thickness of the fuse element at the central part thereof situated at the center between a pair of the terminals is smaller than the thickness of the fuse element at each connection part with the terminal.

According to the fuse assembly described above, since a thickness of the fuse element at the central part thereof situated at the center between a pair of the terminals is formed smaller than a thickness of the fuse element at each connection part with the terminal, therefore the central part of the fuse element blows out.

The thickness of the fuse element continuously or gradually decreases from said each connection part to said central part of the fuse element.

According to the fuse assembly described above, the central part of the fuse element securely blows out.

The fuse element comprises: a pair of supporting parts which contains said connection parts and is connected to each end surface situated at an end of a pair of the terminals, said central part connecting a pair of the supporting parts with each other; and a fixing part for fixing each supporting part of the fuse element to the housing.

According to the fuse assembly described above, since the fixing part fixes each supporting part of the fuse element to the housing, therefore the fuse element hardly vibrates in relation to the terminals.

DESCRIPTION OF THE PREFERRED EMBODIMENTS

Figure 2:
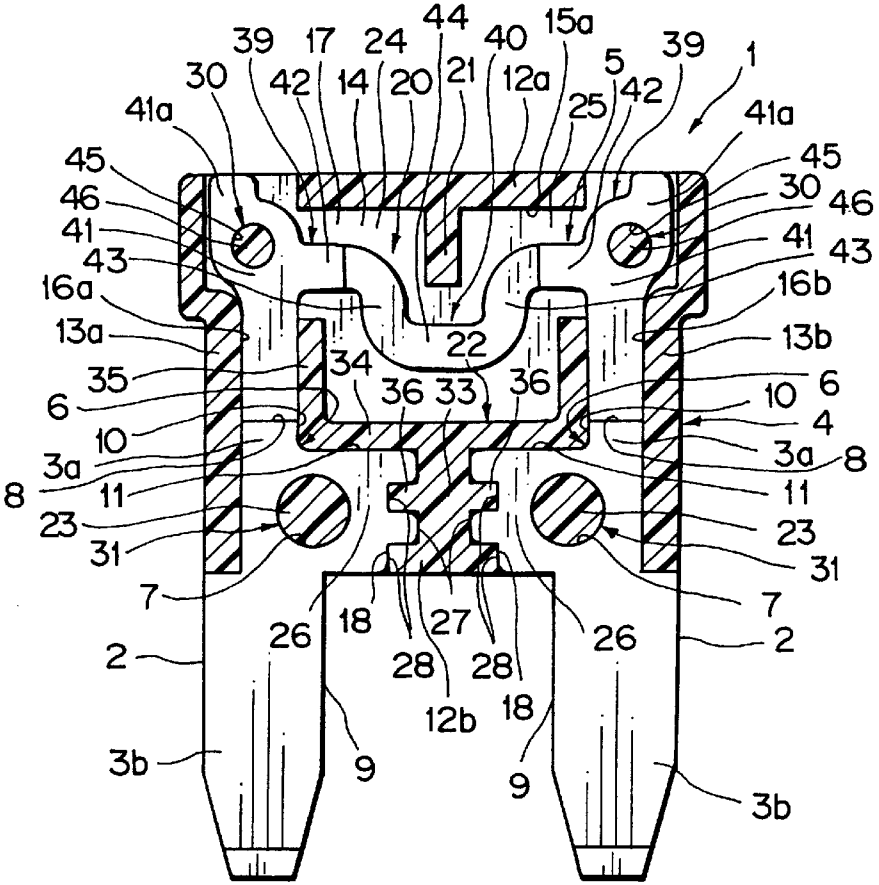
FIG. 2 is a sectional view taken along II—II line in FIG. 1.
Figure 1:
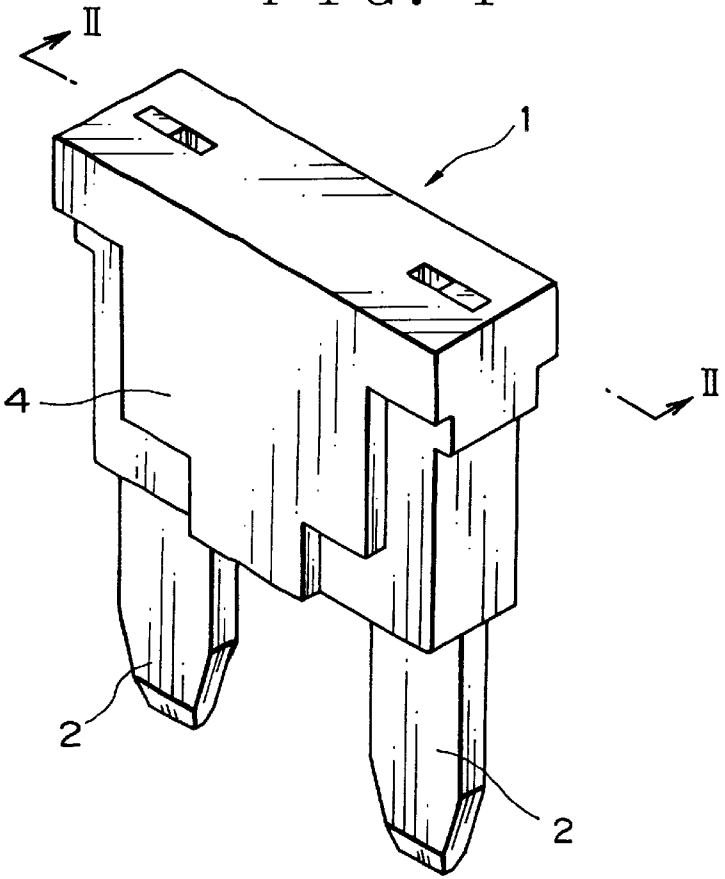
FIG. 1 is a perspective view of a fuse assembly according to a preferred embodiment of the present invention.

In the following, a fuse assembly according to a preferred embodiment of the present invention will be explained with reference to FIGS. 1 to 4. As shown in FIGS. 1 and 2, the fuse assembly 1 according to the preferred embodiment has a pair of terminals 2 arranged in parallel with each other, a housing 4 for receiving ends 3*a* of the terminals 2, a fuse element 5 for connecting a pair of the terminals 2 with each other, a fixing part 30, and a second fixing part 31.

Figure 3A:
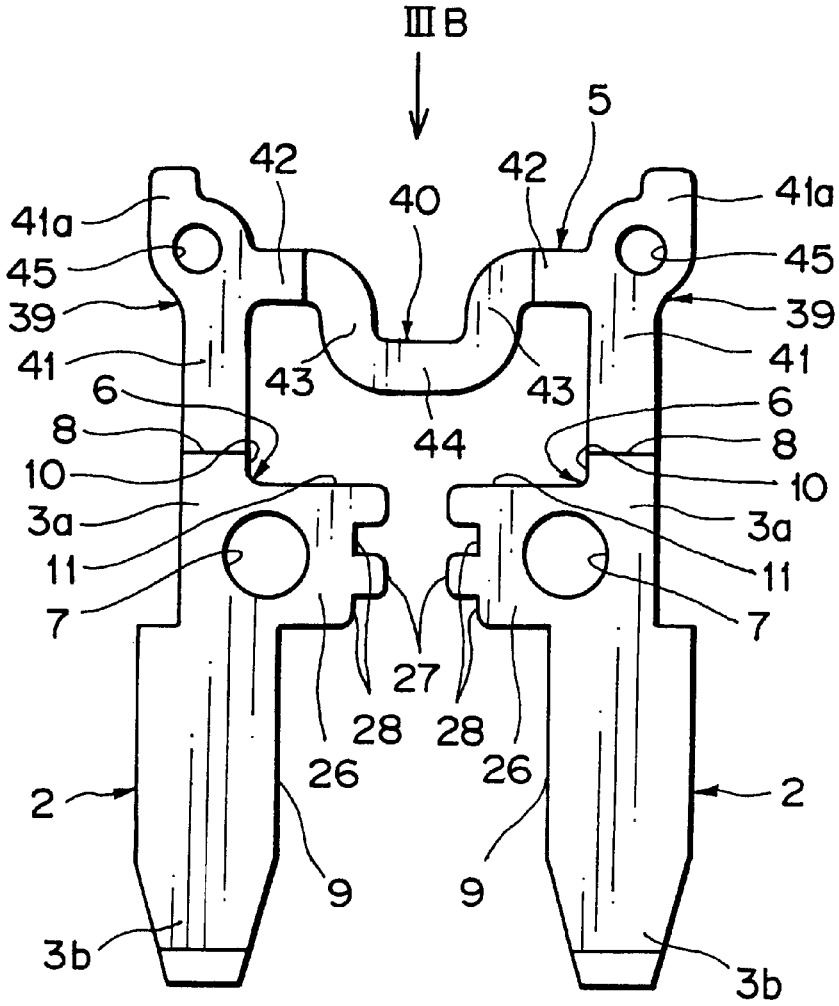
FIG. 3A is a view illustrating terminals and a fuse element of the fuse assembly shown in FIG. 1.

Each terminal 2 formed in a blade-shape is made of an electrically conductive material and a pair of the terminals 2 is arranged in parallel with each other. In the terminal 2, one end 3*a* thereof is received into the housing 4 and an opposite end 3*b* thereof is exposed the outside of the housing 4. As shown in FIGS. 2 and 3A, the terminal 2 has a notched part 6 and a protrusion 26 protruding inwardly in the housing 4.

The notched part 6 is provided to the end 3*a*. The notched part 6 is formed concave in a direction, in which a pair of the terminals 2 aparts from each other from an end surface 27 (described later) of the protrusion 26. The notched part 6 is formed so that a distance between the two terminals 2 increases gradually from a distance between the two protrusions 26.

The notched part 6 has: a flat surface 10 extending toward the center along a direction of the length of the terminal 2 starting from an end surface 8, which is situated at the end 3*a* of the terminal 2; and a step surface 11 which continues the flat surface 10 to an end surface 27 of the protrusion 26.

The flat surface 10 is formed flat along the direction of the length of the terminal 2. A distance between the two flat surfaces 10 is formed longer than that between two inner surfaces 9 of the opposite end 3*b* of the terminal 2.

The step surface 11 is formed along a direction in which a pair of the terminals 2 aparts or approaches with each other, that is, a direction in which the terminals 2 are arranged in parallel. The notched part 6 is received in the housing 4 when the terminal 2 is mounted in the housing 4.

The protrusion 26 is provided to the end 3*a* of the terminal 2. The protrusion 26 is provided at a little center side of the terminal from compared to notched part 6. The protrusion 26 protrudes in a direction that a pair of the terminals 2 approaches with each other from the respective inner surface 9. The protrusion 26 has the end surface 27 and a concaved part 28 formed concave from the end surface 27.

The end surface 27 is formed flat along a direction of the length of the terminal 2. The concaved part 28 is formed concave in a direction that a pair of the terminals 2 aparts from each other from the end surface 27.

In the figure, the two concaved parts 28 are provided to one end surface 27, that is, to one terminal 2. The protrusion 26 is received in the housing 4 when the end 3*a* of the terminal 2 is received in the housing 4.

When the fuse assembly 1 is mounted in an electric junction box, each opposite end 3*b* of the respective terminal 2 is electrically connected to a receiving terminal and the like of the electric junction box. An electric power from a power source and the like is supplied to one of the receiving terminal. Various loads are electrically connected to an opposite receiving terminal. Therefore, an electric power is supplied to one terminal 2 out of the two terminals 2 through the receiving terminal, while a load is connected to an opposite terminal 2.

The housing 4 is made of an insulating synthetic resin and the like. The housing 4 is formed in a box-shape and has a pair of end walls 12*a* and 12*b*, a pair of side walls 13*a* and 13*b*, and a pair of body walls 14 as shown in FIG. 2.

A pair of the end walls 12*a* and 12*b* faces with each other along a direction crossing with the direction in which a pair of the terminals 2 is arranged in parallel. A pair of the end walls 12*a* and 12*b* faces with each other along the direction of the length of the terminal 2. A pair of the end walls 12*a* and 12*b* is in parallel with the end surface 8 when the housing 4 receives terminals 2. The end wall 12*a* out of a pair of the end walls faces the end surface 8 of the terminal 2 with leaving a space therebetween. In the figure, a pair of the end walls 12*a* and 12*b* faces with each other along a direction crossing with the direction, in which a pair of the terminals 2 is arranged in parallel.

A pair of the side walls 13*a* and 13*b* faces with each other along the direction in which a pair of the terminals 2 is arranged in parallel. A pair of the side walls 13*a* and 13*b* is formed along the direction of the length of the terminal 2.

A pair of the body walls 14 faces with each other along a direction crossing with the direction in which a pair of the terminals 2 is arranged in parallel. The body wall 14 extends along the length of the terminal 2. The body wall 14 continues to a pair of the end walls 12*a* and 12*b* and a pair of the side walls 13*a* and 13*b*. In FIG. 2, only a body wall 14 situated at the depths in the figure is shown.

A space 20 (shown in FIG. 2), which is surrounded by an inner surface 15*a* of the end wall 12*a*, the end wall 12*b*, inner surfaces 16*a* and 16*b* of the side walls 13*a* and 13*b*, respectively, and an inner surface 17 of the body wall 14, forms a room for receiving the end 3*a* of the terminal 2.

A pair of through holes 18 which can insert the respective terminals 2 is formed on the end wall 12*b*, which is situated near to the center of the terminal 2, out of a pair of the end walls 12*a* and 12*b*.

The housing 4 has a partition wall 21 and a second partition wall 22. The partition wall 21 extends from the inner surface 15*a* of the end wall 12*a*, which faces the respective end surface 8 with leaving a space therebetween, toward the end wall 12*b*. The partition wall 21 extends along the direction of the length of the side walls 13*a* and 13*b*, and the terminal 2.

The partition wall 21 is provided between a pair of the terminals 2 along a direction in which the terminals are arranged in parallel with each other. The partition wall 21 partitions the space 20 formed in the housing 4 into a first space 24 for receiving the end 3*a* of one terminal out of a pair of the terminals 2 and a second space 25 for receiving the end 3*a* of an opposite terminal out of a pair of the terminals 2. The first space 24 is situated at left and the second space 25 is situated at right in the figure.

The second partition wall 22 has a base wall 33, a horizontal wall 34, and a pair of partitions 35. The base wall 33 extends from an edge of the through hole 18 of the end wall 12*b* toward the inner surface 15*a* of the end wall 12*a* along the direction of the length of the terminal 2. The base wall 33 is arranged between the inner protrusion 26 of a pair of the terminals 2. The base wall 33 has a plurality of protrusions 36 engaging with the concaved parts 28. The base wall 33 covers the end surface 27 of the terminal 2 when the end 3*a* of the terminal 2 is received in the space 20.

The horizontal wall 34 continues to an end of the base wall 33 situated away from the end wall 12*b*. The horizontal wall 34 extends along the direction in which a pair of the terminals 2 is arranged in parallel with each other. The horizontal wall 34 extends from an end near to the inner surface 15*a* of the base wall 33 toward both of a pair of the terminals 2. The horizontal wall 34 is formed along the step surface 11. The horizontal wall 34 covers the step surface 11 of the terminal 2 when the end 3*a* of the terminal 2 is received in the space 20.

A pair of the partitions 35 continues to both ends of the horizontal wall 34 near to a pair of the terminals 2. A pair of the partitions 35 extends from both ends of the horizontal wall 34 toward the inner surface 15*a* and is formed along a flat surface 10 of the notched part 6 of the terminal 2.

A pair of the partitions 35 is arranged in parallel with each other along the direction in which a pair of the terminals 2 is arranged in parallel with each other. Each partition 35 is provided between each inner surface 16*a* and 16*b* of the side wall 13*a* and 13*b*, respectively, and the partition wall 21, along the direction in which a pair of the terminals 2 is arranged in parallel with each other. A pair of the partitions 35 covers the flat surface 10 of the terminal 2 when the end 3*a* of the terminal 2 is received in the space 20.

As shown in FIGS. 2 and 3A, the fuse element 5 connects a pair of the terminals 2 with each other. The fuse element 5 is integrally formed with a pair of the terminals 2. The fuse element 5 is formed in a line shape with its cross section being rectangular shape. The fuse element 5 is formed to have a dimension of width, thickness T2 (shown in FIG. 3B) and length at the central part 40 thereof (explained later) so that the fuse element 5 blows out when the current exceeds a predetermined value.

Figure 3B:
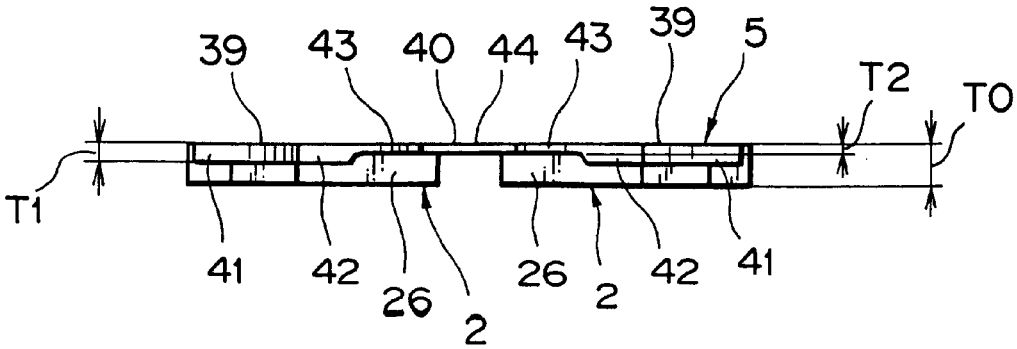
FIG. 3B is a view viewed from a direction of arrow III B in FIG. 3A.

The fuse element 5 connects the end surfaces 8 of the terminal 2 with each other. As shown in FIGS. 2, 3A and 3B, the fuse element 5 has a pair of supporting parts 39 and the central part 40 as a fuse part.

Each supporting part 39 has a first extended part 41 and a second extended part 42. The first extended part 41 extends from the end surface 8 toward the inner surface 15*a* of the end wall 12*a*, that is, in a direction of leaving from a pair of the terminals 2.

The first extended part 41 is formed in a belt shape with one end being connected to the end surface 8. The first extended part 41 is provided between each inner surface 16*a* or 16*b* and the partition 35 along the direction, in which the terminals 2 are arranged in parallel with each other.

The first extended part 41 runs parallel to the side wall 13*a* and 13*b*, the base wall 33, the partition 35 and the partition wall 21. The first extended part 41 corresponds to the connection part described in this specification.

The second extended part 42 is formed in a belt shape with one end being connected to the first extended part 41. The second extended part 42 extends from an end 41*a*, which is away from the end surface 8 of the first extended part 41, in a direction of approaching with each other. The second extended part 42 is provided between an end of the partition 35 and the inner surface 15*a* of the end wall 12*a*. The second extended part 42 is formed along the inner surface 15*a* of the end wall 12*a* and the horizontal wall 34.

As shown in FIG. 3B, a thickness T1 of the supporting part 39 is smaller than a thickness TO of the terminal 2. The thickness T1 corresponds to a thickness of the first extended part 41, that is, a thickness of the connection part.

The central part 40 is situated at the center between the two terminals 2 along the direction in which a pair of the terminals 2 is arranged in parallel with each other. The central part 40 has a pair of third extended parts 43 and the center 44. The third extended part 43 is formed in a belt shape with one end being connected to the second extended part 42. The third extended part 43 extends from an end, to which each second extended part 42 approachs with each other, in a direction of approaching the terminal 2 along the direction of the length of the terminal 2.

The third extended part 43 is provided between a pair of the partitions 35 and the partition wall 21 along the direction in which a pair of the terminals 2 is arranged in parallel with each other. The third extended part 43 runs parallel to the base wall 33, a pair of the partitions 35, the inner surface 16*a* and 16*b*, and the partition wall 21.

The center 44 is formed in a belt shape with connecting ends, at which the third extended part 43 most approaches the terminal 2, with each other. The center 44 is provided between the partition wall 21 and the horizontal wall 34. The center 44 is formed along the inner surface 15*a* of the end wall 12*a*, the end wall 12*b*, and the horizontal wall 34. The center 44 is situated at the center between the two terminals 2 along the direction in which a pair of the terminals 2 is arranged in parallel with each other.

As shown in FIG. 3B, a thickness T2 of the central part 40 is smaller than a thickness T1 of the supporting part 39.

Thus, the fuse element 5, which has the first to third extended part 41 to 43, respectively, and the center 44, is formed bent situating from one terminal 2 to another terminal 2.

The fuse element 5 is formed in a manner that a thickness T1 of the first extended part 41 is larger than a thickness T2 of the center 44. The fuse element 5, which has the supporting part 39 having the thickness T1 and the central part 40 having the thickness T2, is formed in a manner that the thickness thereof decreases gradually in a direction from the first extended part 41 to the center 44, that is, the central part 40.

Figure 4:
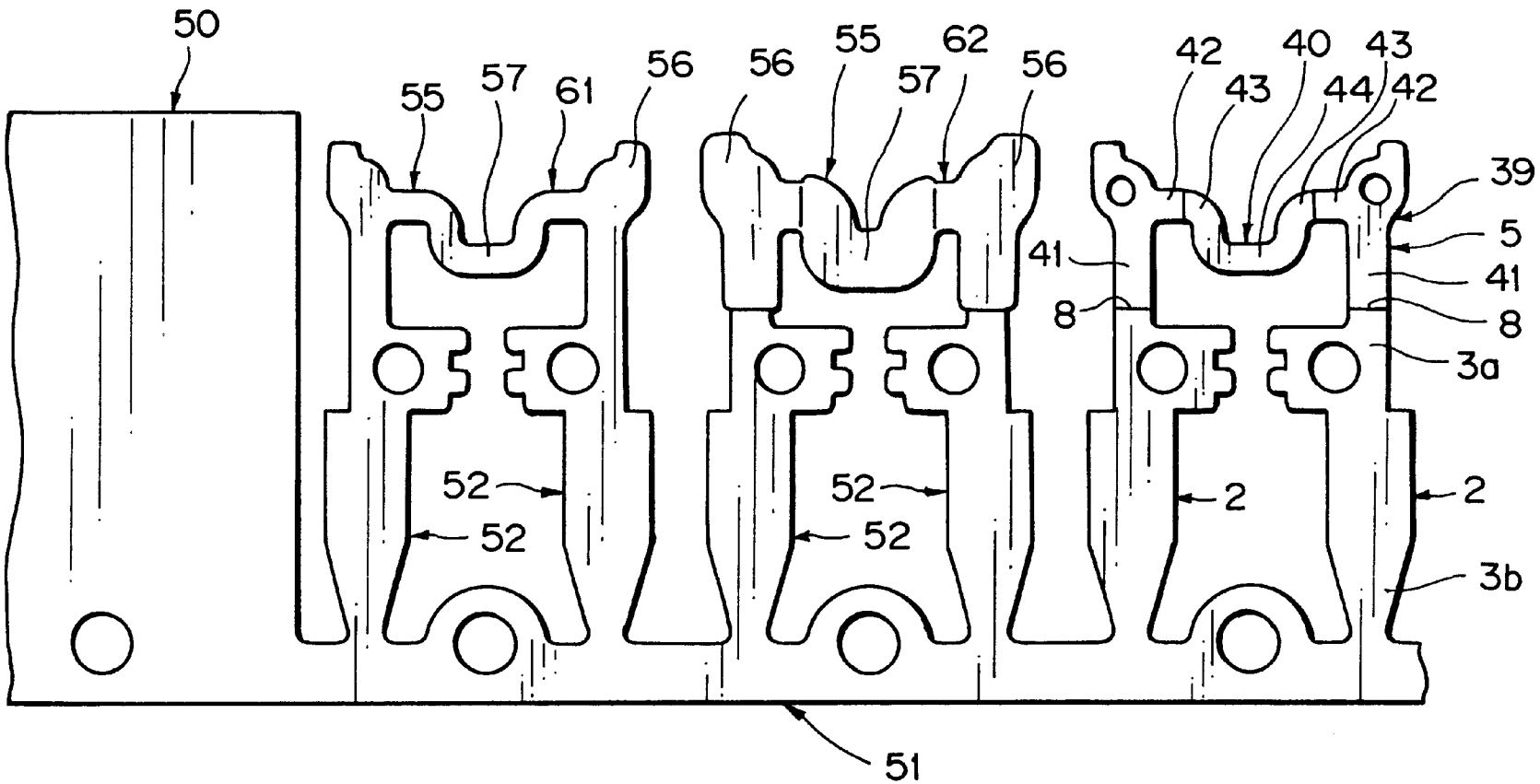
FIG. 4 is a view illustrating a process for molding terminals and a fuse element of the fuse assembly shown in FIG. 1.
Figure 6:
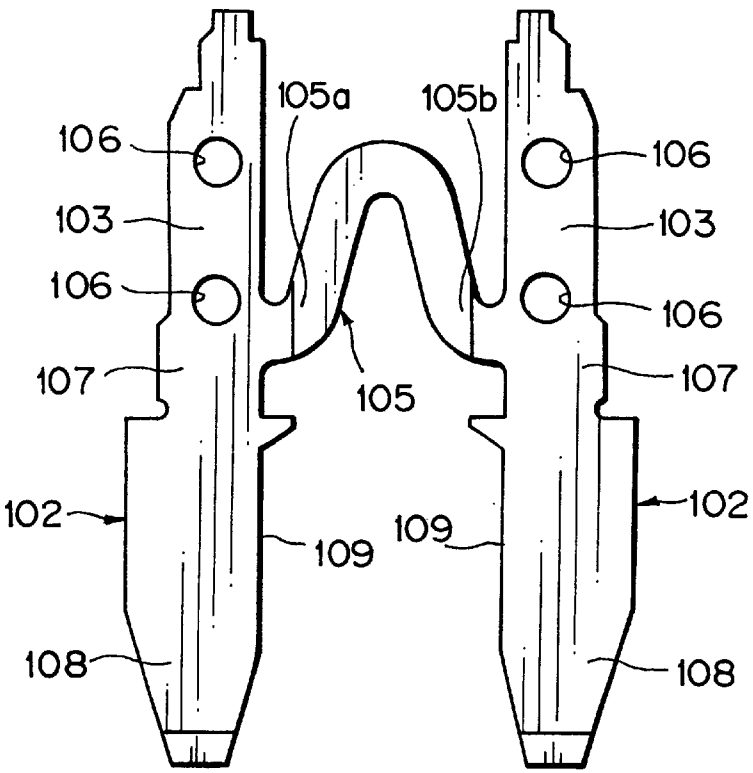
FIG. 6 PRIOR ART
FIG. 6 is a view illustrating terminals and a fuse element of the conventional fuse assembly shown in FIG. 5.
Figure 5:
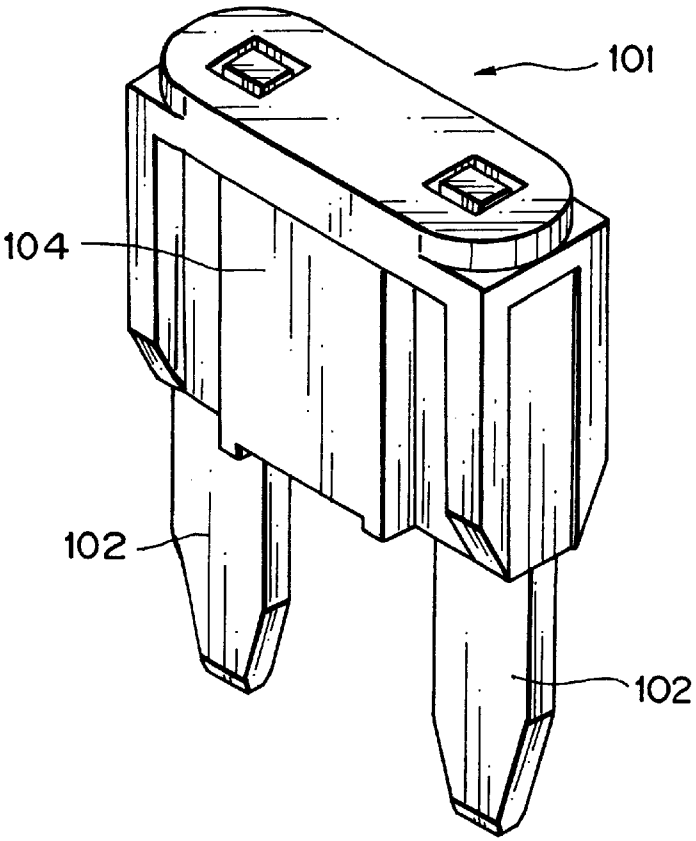
FIG. 5 PRIOR ART
FIG. 5 is a perspective view of a conventional fuse assembly.

As shown in FIG. 4, a belt-shaped material 50 made of electrically conductive metal is subjected to a press working and the like to make a connected body 51, in which the fuse element 5 and a pair of the terminals 2 are integrally formed, then the fuse element 5 and a pair of the terminals 2 are obtained by separation.

In order to form the connected body 51, the material 50 is subjected to a punch working by using a mold corresponding to a shape of the fuse element 5 and the terminals 2 so as to obtain a first intermediate product 61, which has parts 52 and 55 corresponding to the terminal 2 and the fuse element 5, respectively. A thickness of the part 52 is the same as that of the part 55.

Then, a part 56 corresponding to the supporting part 39 and a part 57 corresponding to the central part 40 of the part 55 of the first intermediate product 61 are subjected to rolling, forging or pressing so as to obtain a second intermediate product 62. A thickness of the part 56 of the second intermediate product 62 is formed the same as the thickness T1, while a thickness of the part 57 is formed the same as the thickness T2.

Thereafter, the second intermediate product 62 is subjected to a punch working by using a mold corresponding to a shape of the fuse element 5 and the terminals 2 so as to obtain the terminal 2 and the fuse element 5 formed integrally with each other.

As shown FIG. 2, the fixing part 30 has a through hole 45 and a projection 46. The through hole 45 penetrates through the first extended part 41 of the supporting part 39 of the fuse element 5. The through hole 45 is formed at an end 41a away from the end surface 8 of the first extended part 41. The through hole 45 is formed round in its plane shape.

The projection 46 protrudes from the inner surface 17 of the body wall 14 toward the inside of the space 20. The projection 46 protrudes from at least one inner surface 17 of the body walls 14 in a direction, in which a pair of the body walls 14 approaches with each other.

The projection 46 can engage with the through hole 45. When the projection 46 engages with the through hole 45, the fixing part 30 fixes the fuse element 5 and the housing 4 with each other.

As shown in FIG. 2, the second fixing part 31 has a mounting hole 7 and a projection 23 for positioning the terminal 2. The mounting hole 7 penetrates through the respective terminal 2. Each mounting hole 7 is provided at the end 3*a* of the terminal 2. The mounting hole 7 is formed near to the center of the terminal 2 from the notched part 6.

The projection 23 for positioning the terminal 2 protrudes from at least one inner surface 17 of the body walls 14 in a direction, in which a pair of the body walls 14 approaches with each other. Each projection 23 is provided at a position where is the vicinity of the side wall 13*a* and near to the end wall 12*b* and a position where is the vicinity of the side wall 13*b* and near to the end wall 12*b*.

The projection 23 can engage with the mounting hole 7 of the terminal 2. When the projection 23 engages with the mounting hole 7, the second fixing part 31 fixes a pair of the terminals 2 and the housing 4 with each other.

According to the construction mentioned above, the projection 23 engages with the mounting hole 7, the projection 46 engages with the through hole 45, and each end 3*a* of a pair of the terminals 2 is received in the space 20. At this time, the terminal 2 penetrates through the through hole 18 of the end wall 12*b*.

The fuse assembly 1 is mounted in the electric junction box and the like. When a current value of an electric power supplied to one terminal 2 through the one receiving terminal or the like exceeds the predetermined current value, the central part 40 of fuse element 5 blows out so as to halt the power supply to the load.

As to the fuse assembly 1 according to the preferred embodiment, the thickness T2 of the fuse element 5 at the center 44 of the central part 40 situated at the center of a pair of the terminals 2 is formed smaller than the thickness T1 of the fuse element 5 at the first extended part 41 of the supporting parts 39 as the connection parts with the respective terminals 2. Thus, the thickness of the fuse element 5 is formed so that the thickness gradually decreases from the first extended part 41 up to the central part 40. Thereby, when the fuse element 5 blows out, the central part 40 securely blows out.

Therefore, a distance between the blown part of the fuse element 5 and the first extended part 41 after the blowout can be controlled and the fuse element 5 after the blowout can be prevented from vibrating due to the vibration of the vehicle in relation to the terminal 2. Thereby, a pair of the blown ports of the fuse element 5 can be prevented from coming into contact with each other and the electric power supply to the load can be securely halted after the blowout of the fuse element 5.

The fixing part 30 fixes the housing 40 and the fuse element 5 with each other. Therefore, the fuse element 5 can be securely prevented from vibrating due to the vibration of the vehicle in relation to the terminal 2 after the blowout of the fuse element 5. Thereby, a pair of the blown parts can be prevented from coming into contact with each other and the electric power supply to the load can be more securely halted after the blowout of the fuse element 5.

As to the preferred embodiment, the thickness T2 of the fuse element 5 at the central part 40 is formed smaller than the thickness T1 of the fuse element 5 at the supporting parts 39 with changing the thickness gradually.

However, the thickness of the fuse element 5 may be formed with gradually decreasing from the first extended part 41 up to the center 44 of the central part 40 of the fuse element 5.

The aforementioned preferred embodiments are described to aid in understanding the present invention and variations may be made by one skilled in the art without departing from the spirit and scope of the present invention.

What is claimed is:

1. A fuse assembly comprising a pair of terminals arranged in parallel with each other;

a housing for receiving each one end of a pair of the terminals; and a fuse element for connecting a pair of the terminals with each other, wherein a thickness of the fuse element at the central part thereof situated at the center between a pair of the terminals is smaller than the thickness of the fuse element at each connection part with the terminal;

wherein the fuse element comprises:

a pair of supporting parts which contains said connection parts and is connected to each end surface situated at an end of a pair of the terminals, said central part connecting a pair of the supporting parts with each other;

wherein the thickness of the supporting parts is smaller than the thickness of the terminals.

2. The fuse assembly according to claim 1, wherein the thickness of the fuse element continuously or gradually decreases from said each connection part to said central part of the fuse element.

3. The fuse assembly according to claim 2, wherein the fuse element further comprises:

a fixing part for fixing each supporting part of the fuse element to the housing.

* * * * *